US007547011B2

(12) United States Patent
Kurata et al.

(10) Patent No.: US 7,547,011 B2
(45) Date of Patent: Jun. 16, 2009

(54) SHEET FEEDING DEVICE AND IMAGE FORMING APPARATUS

(75) Inventors: Tetsuji Kurata, Yokohama (JP); Kosuke Yamamoto, Yokohama (JP); Junichi Yoshikawa, Tokyo (JP); Yasuyuki Hirai, Yokohama (JP); Yoshitaka Okamura, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 297 days.

(21) Appl. No.: 11/434,172

(22) Filed: May 16, 2006

(65) Prior Publication Data

US 2006/0262355 A1 Nov. 23, 2006

(30) Foreign Application Priority Data

May 18, 2005 (JP) ..... 2005-145093
Sep. 9, 2005 (JP) ..... 2005-261520

(51) Int. Cl.
*B65H 3/44* (2006.01)
*B65H 5/26* (2006.01)

(52) U.S. Cl. ..... 271/9.11; 271/9.01; 271/9.05; 271/9.06; 271/158; 271/162; 271/164; 271/159; 271/157

(58) Field of Classification Search ..... 271/145, 271/158, 162, 164, 159, 9.01, 9.05, 9.06, 271/9.11, 147, 171, 157
See application file for complete search history.

(56) References Cited

U.S. PATENT DOCUMENTS 3,955,811 A * 5/1976 Gibson ..... 271/9.05
4,032,137 A * 6/1977 Katayama et al. ..... 271/164
4,444,386 A * 4/1984 Murata et al. ..... 271/127
4,449,705 A * 5/1984 Shibuya et al. ..... 271/9.09
4,854,570 A * 8/1989 Martin et al. ..... 271/162
5,071,032 A * 12/1991 Thornton et al. ..... 221/154
5,120,040 A * 6/1992 Worley ..... 271/9.07
5,145,166 A * 9/1992 Neudecker et al. ..... 271/164
5,346,197 A * 9/1994 Takano et al. ..... 271/9.05
5,957,447 A * 9/1999 Sekine ..... 271/9.09
6,252,654 B1 * 6/2001 Kaya ..... 355/408
6,641,047 B2 * 11/2003 Ito et al. ..... 235/475
6,676,316 B2 * 1/2004 Mindler et al. ..... 400/624
7,140,795 B2 * 11/2006 Shiraishi et al. ..... 400/624
7,245,869 B2 * 7/2007 Kim et al. ..... 399/377
7,322,763 B2 * 1/2008 Yang ..... 400/624
2002/0056961 A1 * 5/2002 Sasaki et al. ..... 271/145
2006/0163798 A1 * 7/2006 Wong et al. ..... 271/162

FOREIGN PATENT DOCUMENTS

JP 61-188335 8/1986
JP 5-17064 1/1993
JP 6-40582 2/1994
JP 2002-87682 3/2002

* cited by examiner

*Primary Examiner*—Patrick H Mackey
*Assistant Examiner*—Prasad V Gokhale
(74) *Attorney, Agent, or Firm*—Fitzpatrick, Cella, Harper & Scinto

(57) ABSTRACT

A burden on a user when changing sheets such as with an ink jet printer and the like is reduced, and the necessary stack space is secured without considering the step difference up to the mounting surface of an ejected paper tray worth of the amount of curls for sheets that easily curls such as post cards and the like. Thus, enlargement of the apparatus and increase in the manufacturing cost are suppressed, and is easily adopted for low cost type for mass consumption.

14 Claims, 18 Drawing Sheets

SHEET FEEDING DEVICE AND IMAGE FORMING APPARATUS

BACKGROUND OF THE INVENTION

1. Field of the Invention

The present invention relates to an image forming apparatus such as a copying machine, a facsimile device, a printer and the like, and also relates to a sheet feeding device arranged in the image forming apparatus for feeding a sheet-like recording medium (hereinafter referred to as sheet) to an image forming section.

2. Description of the Related Art

The sheet feeding device for feeding the sheet to an engine section that performs printing in an ink jet recording apparatus, one form of image forming apparatus, may adopt an auto sheet feeder (ASF) method or a paper feeding cassette method. In the ASF method, the sheet directly accommodated in the recording apparatus main body is fed, whereas in the paper feeding cassette method, a cassette is detachably attachable with respect to the recording apparatus main body with the sheets accommodated therein. A sheet feeding device combining the ASF method and the paper feeding cassette method is recently being put to practical use. In cases of large printer or copying machine, in particular, a model in which the sheet feeding devices having the same configuration are arranged in multiple levels to allow the sheets to be selectively fed is put to practical use.

With regards to the paper feeding cassette method, it is proposed that a sub-cassette is inserted above the main cassette to allow the sheets of different size to be selectively fed (Japanese Patent Application Laid-Open No. S61-188335). A configuration in which the sub-cassette is arranged overlapping the main cassette and feeding the sheet with separate paper feeding rollers is also proposed (Japanese Patent Application Laid-Open No. H06-40582). When such main cassette and sub-cassette are arranged, the plain papers such as A4 size are set in the main cassette and the thick L-size photo recording papers or post cards are set in the sub-cassette in many cases.

There are various types of sheets in recent years, and even printers and the like are able to respond to various printing. In particular, since the ink jet printer is a non-contact printing, the types of sheets are rarely limited, and thus the size and types of sheets are further increased, and the frequency of changing the sheets to be mounted accordingly becomes extremely high. A configuration in which a plurality of sheet feeding devices can be mounted so as to respond to sheets of different sizes even for a relatively low cost type printer is desired.

Behaviors exhibited by sheets during transportation also vary due to diversification. For instance, sheets such as ink jet post cards, glossy post cards, cards and business card size having a liquid ink receiving layer show the following behavior. Immediately after applying liquid ink during printing, some sheets greatly warp once and then curl, but such curl decreases and disappears with time and restores to its original shape. Since A4 sheets and the like having a size greater than the post card have a large sheet weight, large curls as seen in the sheet of small size are not produced. When curls are produced, the succeeding sheet may eject the previous first sheet together or the succeeding sheet may rub against the recorded surface of the previous sheet when ejecting the succeeding second sheet. In order to prevent such disadvantages, the step difference from the sheet ejecting port to the mounting surface of the ejected paper tray is sufficiently secured in the prior art even for small printers. However, with the ejected paper tray of a fixed configuration having the position of the sufficient step difference as a fixed position, many disadvantages arise in terms of high stacking performance of adapting to the size and type of the ejected sheet, and allowing as much sheet as possible to be mounted while aligning.

An apparatus in which the ejected paper tray is not fixed at the position having a step difference from the sheet ejecting port, and the ejected paper tray is moved in the up an down direction or in the vertical direction with driving means is proposed in order to achieve the ejected paper tray of high stacking performance (Japanese Patent Application Laid-Open No. H05-17064). Further, a configuration in which the plain cut papers are mounted on the main bottom plate of the ejected paper tray, and envelopes and the like are mounted on a sub-bottom plate arranged at one part of the main bottom plate to enhance the stacking performance is proposed (Japanese Patent Application Laid-Open No. 2002-87682). In this case, the main bottom plate is supported by a spring from below, and the main bottom plate elastically compresses the spring and sinks in response to the weight of the sheet. Since the sub-bottom plate is for small envelopes, the spring force of the spring for the sub-bottom plate is large compared to that of the spring for the main bottom plate. Therefore, in the case of envelopes, the spring is compressed by way of the sub-bottom plate after a greater number of papers than the plain cut papers are mounted. Thus, the stacking performance is enhanced even in the case of small envelopes having a sheet thickness of a few times greater than the plain cut paper by mounting a great number of papers.

However, the prior arts have the following problems. The sheet feeding device disclosed in Japanese Patent Application Laid-Open No. S61-188335 is troublesome in that the cassette must be changed manually, and the sub-cassette must be taken out and stored each time when using the main cassette.

Further, in the case of the sheet feeding device disclosed in Japanese Patent Application Laid-Open No. H06-40582, the occupying space of the sheet feeding device becomes extremely large with respect to the printer main body.

Further, with regards to the mounting tray disclosed in Japanese Patent Application Laid-Open No. 2002-87682, if the step difference from the sheet ejecting port to the mounting surface of the ejected paper tray is sufficiently secured so as to correspond to various sheets, the device becomes larger by such amount. In addition, driving means for moving the ejected paper tray up and down is arranged, whereby the device becomes larger and more complicating with increase in the driving motor and the drive transmission means.

Moreover, in the image forming apparatus disclosed in Japanese Patent Application Laid-Open No. H05-17064, the position in the up and down direction of the main bottom plate and the sub-bottom plate is determined by balancing the spring force of the spring and the sheet mounted weight. Therefore, the sheet mounting amount at the main bottom plate and the sub-bottom plate is not guaranteed if the spring properties of the springs of the main bottom plate and the sub-bottom plate vary. In addition, diversification of the sheet type cannot be responded with a unique spring force.

SUMMARY OF THE INVENTION

It is an object of the present invention to provide a sheet feeding device that alleviates the work of the user when changing the cassette, that miniaturizes the device, and that enhances stacking performance of the ejected sheets and the like, and an image forming apparatus.

It is an another object of the present invention to provide a sheet feeding device including a cassette type sheet accommodating section that is detachably attachable with respect to the image forming apparatus main body with the sheets accommodated inside, wherein the sheet accommodating section includes a main accommodating part and a sub-accommodating part for simultaneously accommodating sheets of different size, the sub-accommodating part is arranged to be movable in the sheet feeding direction to a cover member for opening and closing the main accommodating part, and the sheet can be fed from the sub-accommodating part while being attached to the image forming apparatus main body.

DETAILED DESCRIPTION OF THE PREFERRED EMBODIMENTS

An ink jet printer which is a preferred embodiment of an image forming apparatus according to the present invention and a sheet feeding device arranged in the printer main body will now be described with reference to the drawings.

First Embodiment

Figure 1:
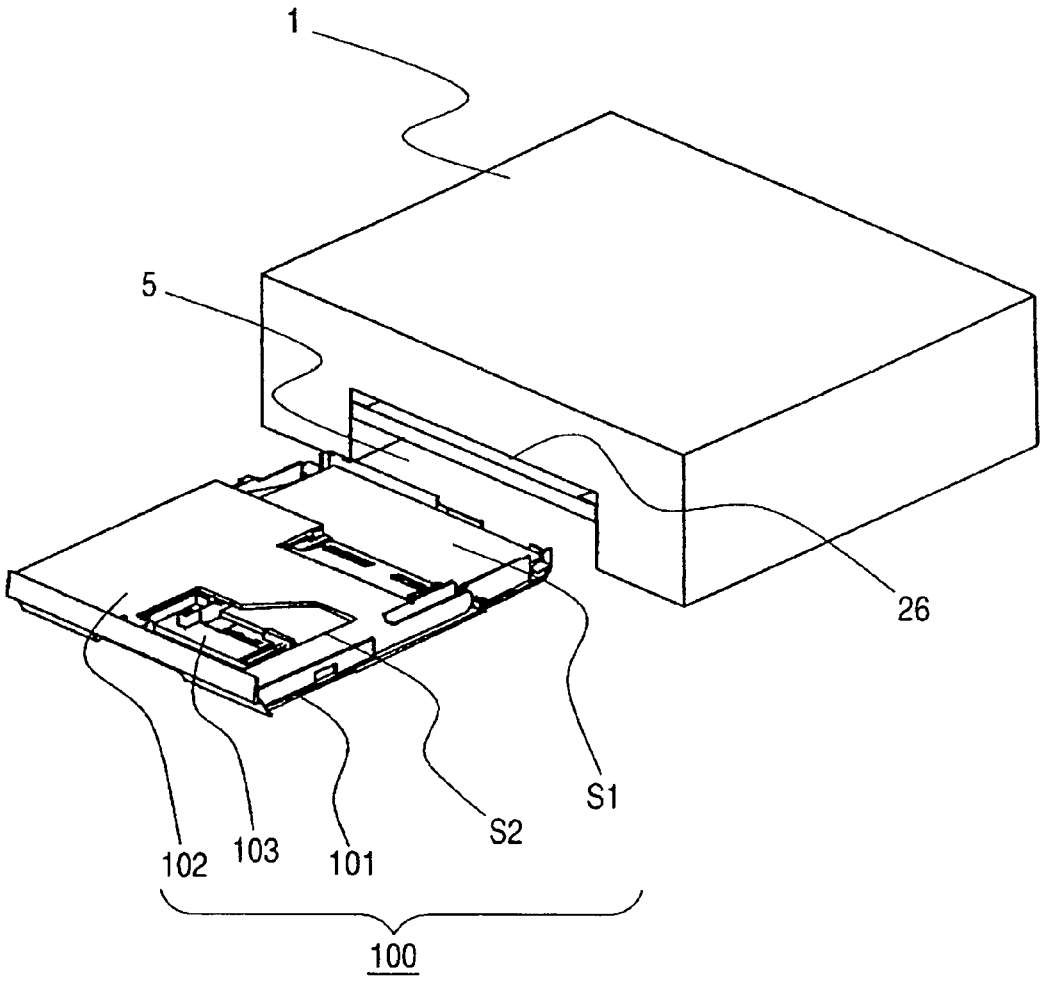
FIG. 1 is an entire perspective view showing an ink jet printer and a sheet feeding device arranged thereon of an embodiment of an image forming apparatus according to the present invention.

As shown in FIG. 1, a paper feeding cassette (sheet accommodating section) 100 configuring the sheet feeding device is detachably removable to a cassette inserting port 5 opened at the front surface of a printer main body 1 while accommodating sheets S. The sheet S in which printing is completed is ejected from a paper ejecting port 26.

Figure 2:
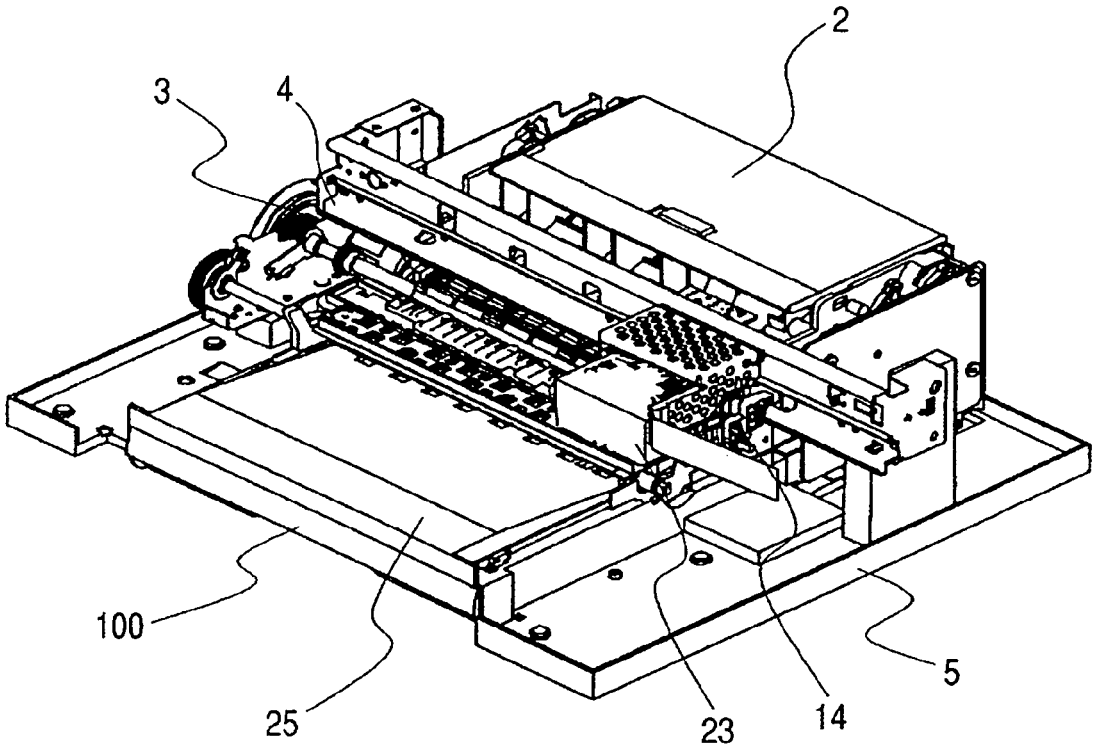
FIG. 2 is a perspective view showing a main engine configuration.

In FIG. 2 showing an internal configuration of the printer main body 1, a paper feeding unit 2 configuring the sheet feeding device with the paper feeding cassette 100 detachably attachable at below the engine is arranged, and the sheet S from the paper feeding cassette 100 is conveyed to an LF unit 3. A CR unit 4 includes a carriage 14 mounted with a recording head 23 to implement printing, and is a mechanism for reciprocating the carriage 14 in the sub-scanning direction of the sheet S. Both units of the paper feeding unit 2 and the CR unit 4 each has its own driving motor, and performs printing operation in cooperation.

Figure 3:
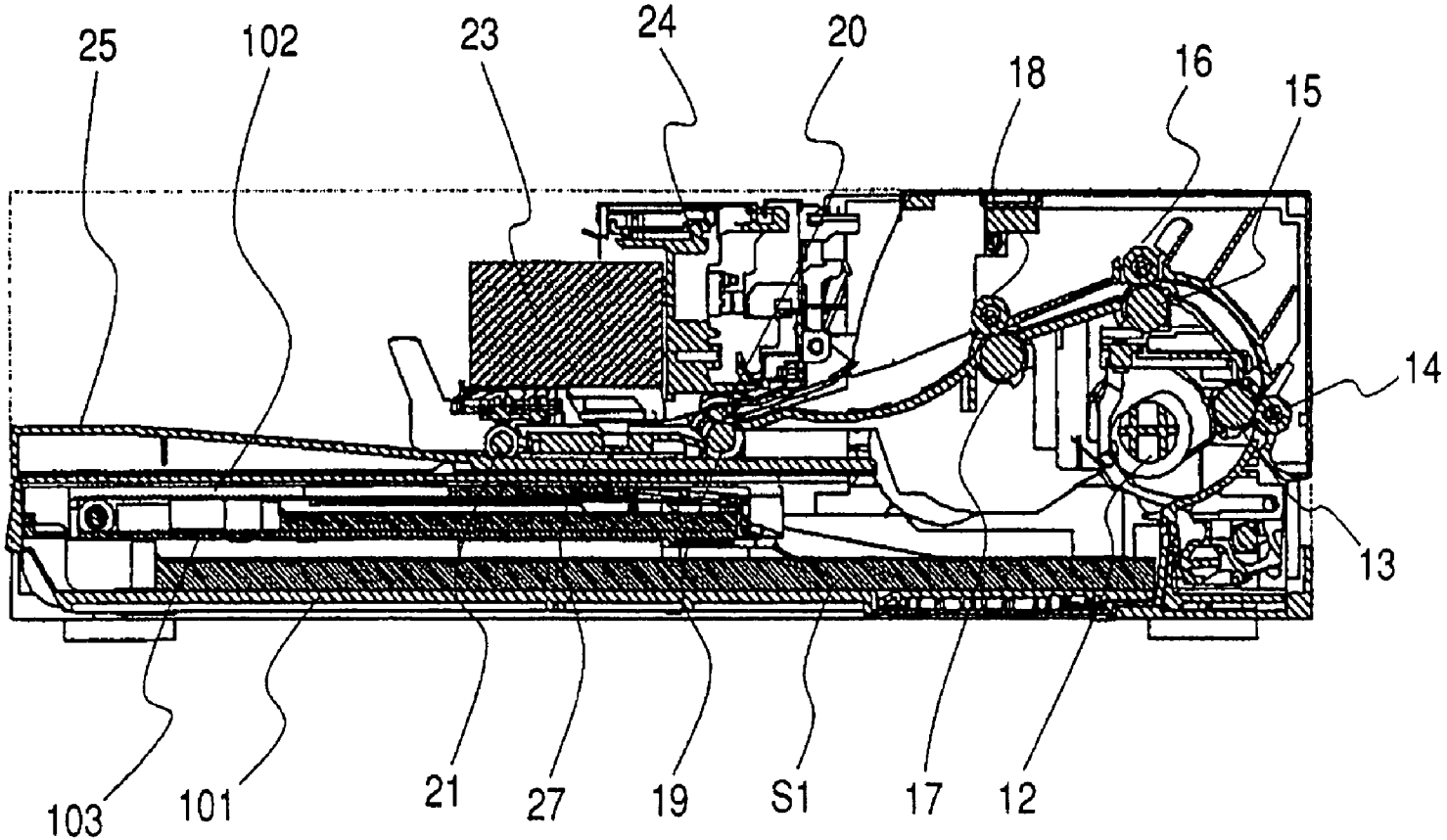
FIG. 3 is a side cross sectional view showing the engine configuration.

FIG. 3 shows a paper path (sheet conveying path) in printing. A paper feeding roller 12 is a member that picks up and feeds the sheet S from the paper feeding cassette 100 one at a time. The sheet S picked up from the paper feeding cassette 100 is conveyed through the conveying path by conveying rollers 13, 15, 17. An LF roller 19, and pinch rollers 14, 16, 18, 20 are members for sandwiching and forwarding the sheet S between the rollers. The sheet S conveyed to the LF roller 19 is supported by a platen 27, and conveyed to a position distant by a predetermined distance with respect to the recording head 23. In synchronization therewith, the carriage reciprocates and an image is formed on the sheet S by the recording head 23 and printing is performed. The paper ejecting roller 21 ejects the printed sheet S, and a spur 22 pushes the sheet S down. The sheet S in which printing is completed is conveyed in the direction of arrow in the figure. An ejected paper tray 25 is extensible according to the size of the ejected sheet S, and mounts and stacks the sheets S.

Figure 4:
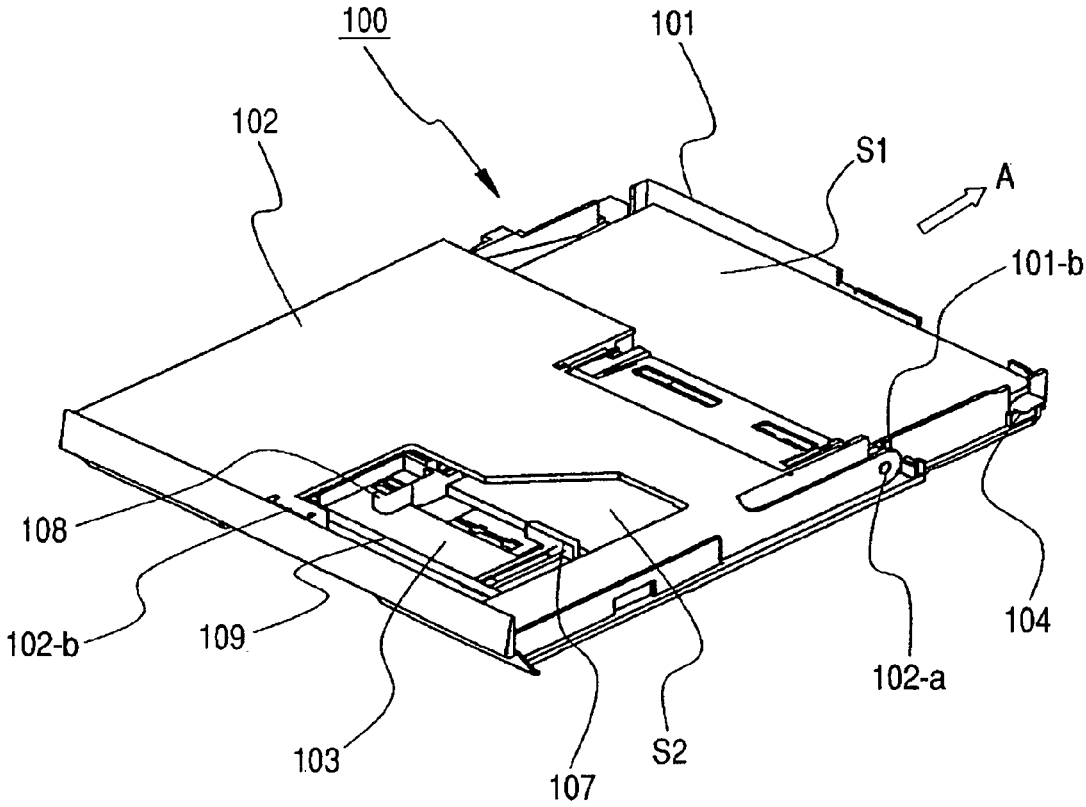
FIG. 4 is a perspective view showing a paper feeding cassette as a single body.
Figure 5:
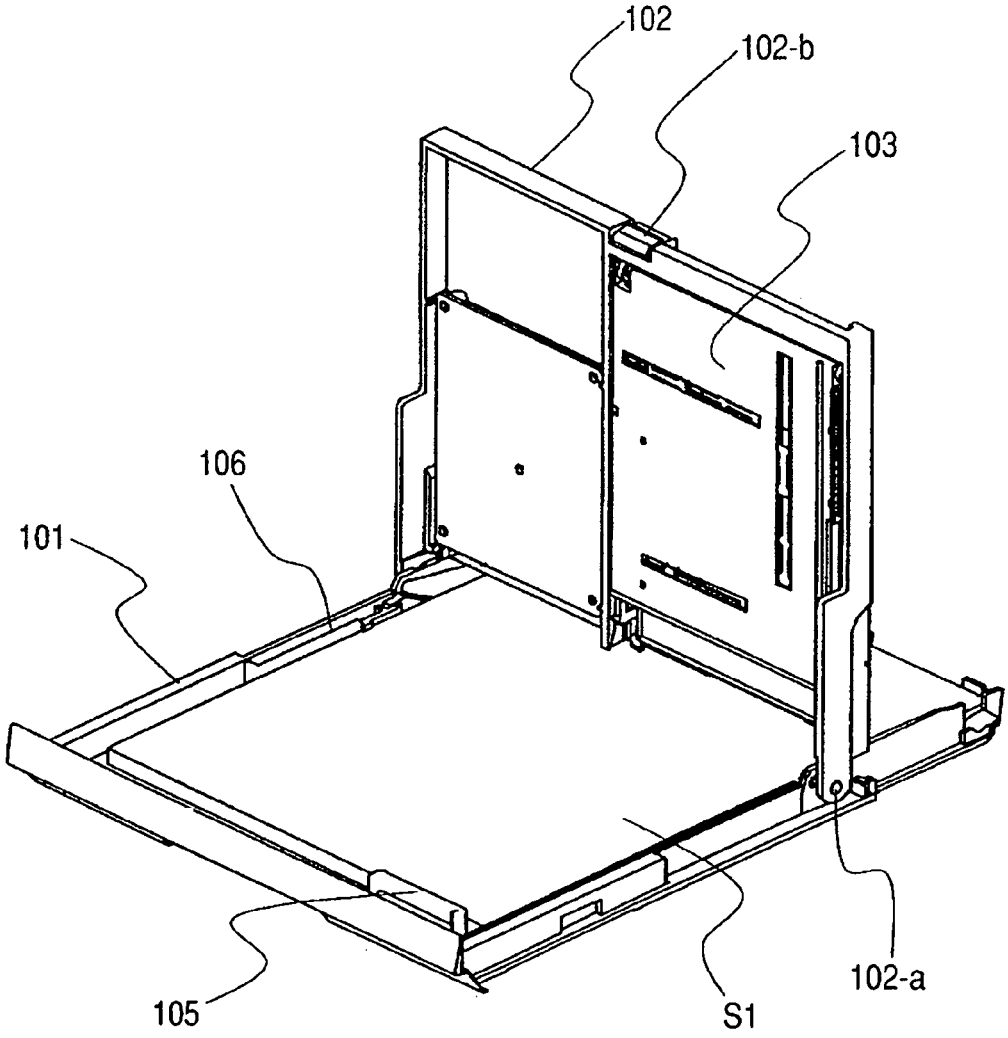
FIG. 5 is a perspective view showing the paper feeding cassette with a cover in an opened state.

FIG. 4 shows the paper feeding cassette as a single body. The paper feeding cassette 100 includes a main cassette (main accommodating part) 101, the sheet S1 of large size such as A4 and the like of plain cut paper being loaded therein, and forwards the sheet S1 in the paper feeding direction shown with an arrow A. The main cassette 101 is provided with a pushing plate 104 for pushing up the bundle of loaded sheet S from below and pressure contacting the upper most sheet S to the paper feeding roller 12 (FIG. 3). Further, a cover 102 that covers most part of the main cassette 101 is arranged, which the cover 102 can swing in a direction of opening the main cassette 101 by way of left and right supporting shaft pins 102*a* as shown in FIG. 5. A sub-cassette (sub-accommodating part) 103 is built in and housed inside the cover 102. The sub-cassette 103 is loaded with sheets having a size smaller than sheets S1 loaded in the main cassette 101, for example, sheets S2 such as post cards or of L-size. The sheet S2 is refilled in a state of FIG. 4. The sheets S2 in time of refill are aligned by being positioned with an end guide 107 and a side guide 108.

As shown in FIG. 5, the cover 102 is raised substantially vertically with respect to the main cassette 101 with the supporting shaft pin 102*a* as the swing supporting point, and can be removed along with the supporting shaft pin 102*a* from the main cassette 101 in such raised orientation. The sheets S1 are refilled to the main cassette 101 in the cover removing state. The refilled sheets S1 have the sheet edges positioned and aligned by contacting the end guide 105 and a side guide 106. When the cover 102 is in the closed state (see FIG. 4, FIG. 6, FIG. 7), a nail 102*b* (see FIG. 4) arranged at the distal end of the cover engages the main cassette 101 side thereby locking the cover 102.

The sub-cassette 103 incorporated in the cover 102 is guided by fitting a guide pin 103*a* he sub-cassette 103 side and a guide shaft 109 to two guide grooves 102*c* (FIG. 7) arranged in the cover 102 and can be moved in the sheet feeding direction. A phase gear 110 is arranged to prevent trouble from occurring at the sub-cassette 103 during the movement. In other words, the guide shaft 109 is arranged in a freely rotating manner to the sub-cassette 103 and both ends of the guide shaft 109 are fitted to the guide groove 102*c*. Thus, the phase gear 110 that rotates in phase with both ends of the shaft is geared to a gear rack 102*d* arranged at the roof of the cover 102.

A paper feeding guide 113 for positioning the sheet S2 loaded in the sub-cassette 103 with the side position (edge) as the reference is arranged, which paper feeding guide 113 is fixed to the sub-cassette 103 with a thin member performed with sheet metal processing and the like. The sheet S2 is moved to one side by the side guide 108 and the end guide 107 with respect to the reference side. The top plate of the paper feeding guide 113 has the left and the right connected so as to cover to the sheet S2 to prevent warp of the sheet S2. The reference side is opened largely to easily load the sheet of smaller size (card size etc.). The distal end has the distal end aligned by a stop lever 112. The stop lever 112 is movable in the up and down direction and movably floated by a spring so as to move away from the feeding surface of the sheet S2 when feeding the sheet from the sub-cassette 103. Further, the sheet S2 in the sub-cassette 102 is prevented from accidentally jumping out even if the orientation of the cover 102 is changed by a shutter 111 supported in a freely rotating manner at the cover 102 so as to cover the stop lever 112.

Figure 6:
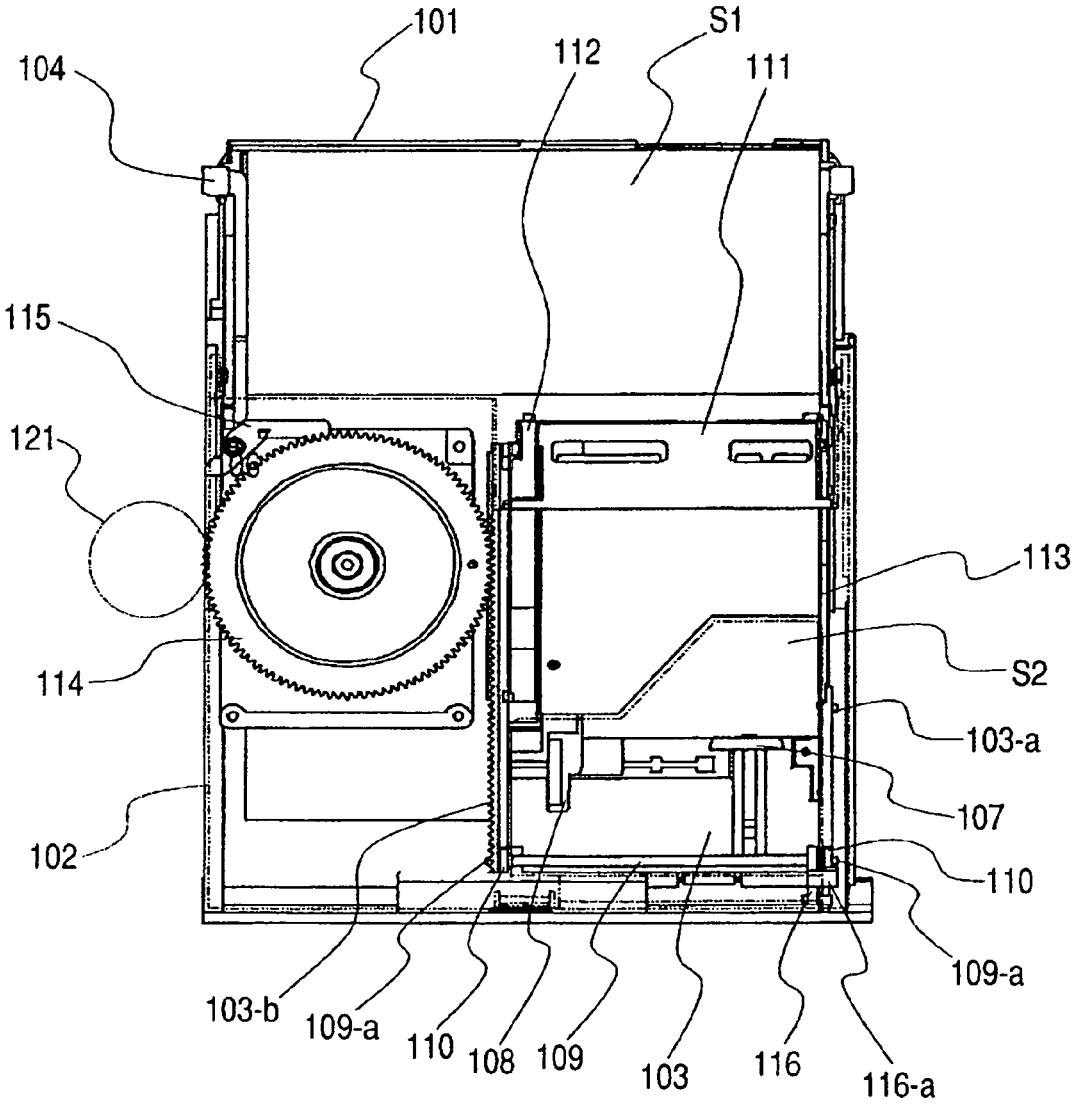
FIG. 6 is a plan view showing an internal configuration of the paper feeding cassette.
Figure 7:
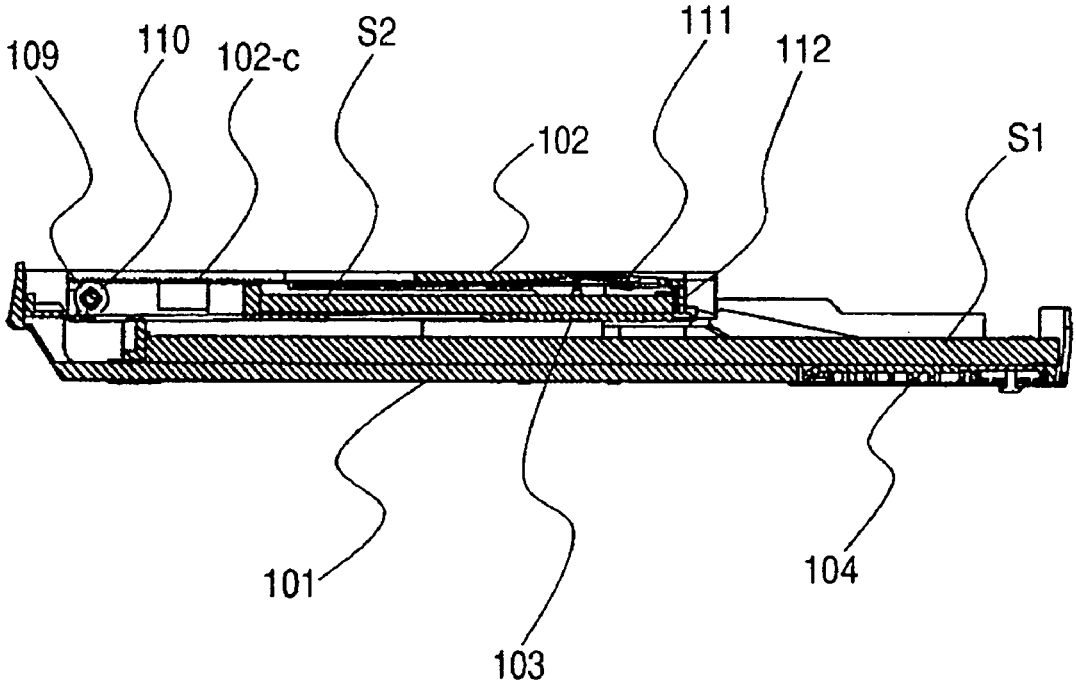
FIG. 7 is a side cross sectional view showing an internal configuration of the paper feeding cassette.
Figure 8:
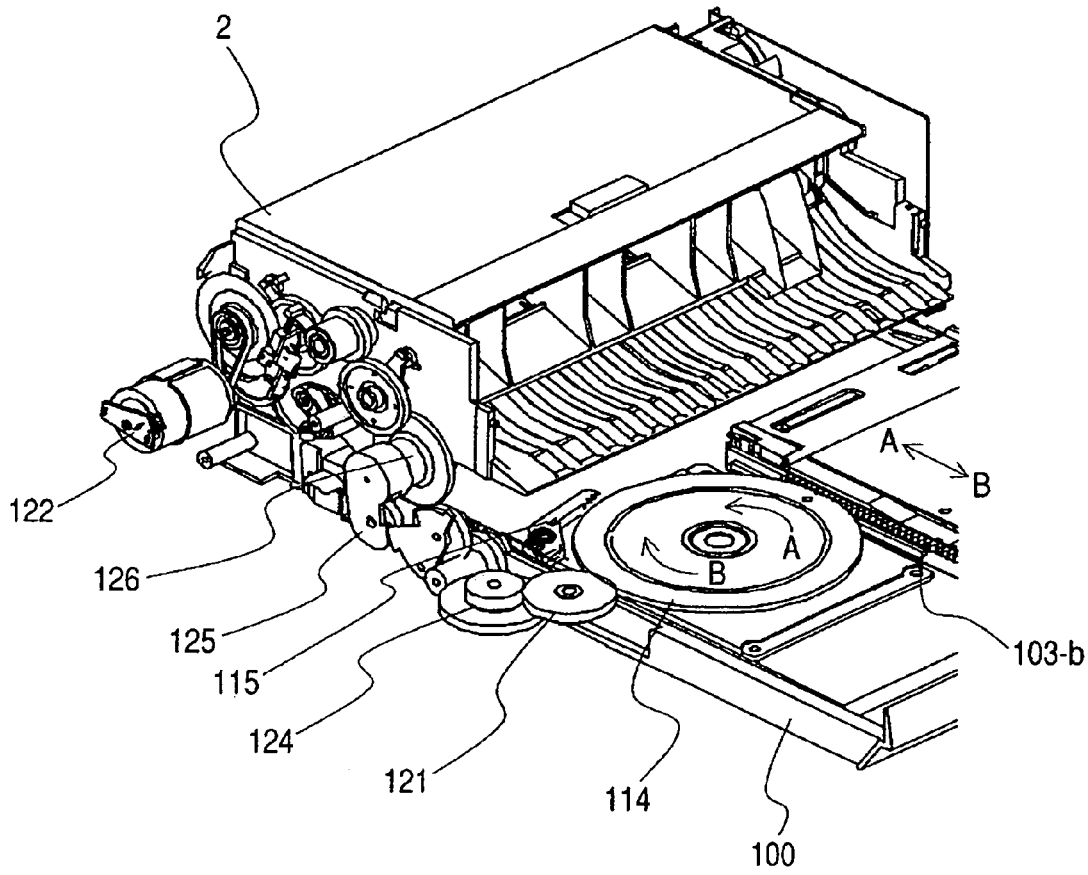
FIG. 8 is a perspective view showing a transmission gear train coupled to a printer main body in attaching the paper feeding cassette.

As apparent from FIG. 6 and FIG. 8, a gear rack 103*b* is arranged on the side surface of the sub-cassette 103, which the gear rack 103*b* is geared with a coupling gear (transmission member) 114 on the rotating shaft arranged on the inner side surface of the cover 102. The coupling gear 114 gears with a transmission gear 121 arranged on the printer main body 1 side and waits when the paper feeding cassette 100 is inserted and attached to the printer main body 1. The rotational power is transmitted from the main body driving source to the transmission gear 121, and converts the rotational power to a linear movement in the sheet feeding direction of the sub-cassette 103 by way of the coupling gear 114 and the gear rack 103*b*. A stopper (lock member) 115 is engaged with and detached from the coupling gear 114, wherein the stopper releases engagement with the coupling gear 114 and releases the lock to allow the coupling gear 114 to rotate in attaching the paper feeding cassette, and engages the coupling gear 114, as shown in FIG. 6, to lock the rotation in taking out the paper feeding cassette. Thus, the sub-cassette 103 is prevented from accidentally moving by locking the rotation of the coupling gear 114 or releasing the lock.

In FIG. 6, a lever 116 for detecting the sub-cassette 103 is arranged, and is attached at a position that can contact the guide shaft 109 of the sub-cassette 103 to detect whether or not the sub-cassette 103 is in a waiting position (home position). When the sub-cassette 103 moves in the sheet feeding direction and detaches from the guide shaft 109, the sub-cassette detection lever 116 swings and the height of a detecting part 116*a* changes. The presence of the sub-cassette 103 is detected by a home position sensor 130 by way of a detection lever 131 (see FIG. 9) arranged on the printer main body 1 side, and controls the home position of the sub-cassette 103.

FIG. 8 shows the transmission gear train in attaching the paper feeding cassette. A paper feeding motor 122 for rotatably driving the paper feeding roller 12 is used as a driving source for moving the sub-cassette. In other words, the rotational power of the paper feeding motor 122 is transmitted to the transmission gear train, thereby moving of the sub-cassette 103 from the coupling gear 114 via a gear rack 10*b*. The paper feeding motor 122 detaches the paper feeding trigger in reverse rotation, and drives the paper feeding roller 12 and the PF roller in forward rotation, and thus moves the sub-cassette 103 by using only the forward rotation. A switching mechanism 125 for changing the rotating direction from the paper feeding motor 122 or blocking the rotation is arranged in the middle of the transmission gear train, so that the rotation from the paper feeding motor 122 is set to one of the states of forward rotation, reverse rotation, or disconnection. A clutch gear 124 sandwiching the friction clutch is inserted to the gear at a position proximate the final stage of the gear train. Since the switching mechanism 125 is in the "disconnected" state when the paper feeding cassette 100 is attached to the printer main body 1, the paper feeding motor 122 can be operated without limitation. It should be recognized again that the stopper 115 engaging the coupling gear 114 and locking the rotation is detached and separated from the coupling gear 114 in conjunction with the insertion and attachment operation of the paper feeding cassette 100 to the printer main body 1, so that lock is released to allow free rotation.

(Feeding Operation of Sheet S1 from the Main Cassette 101)

Figure 9:
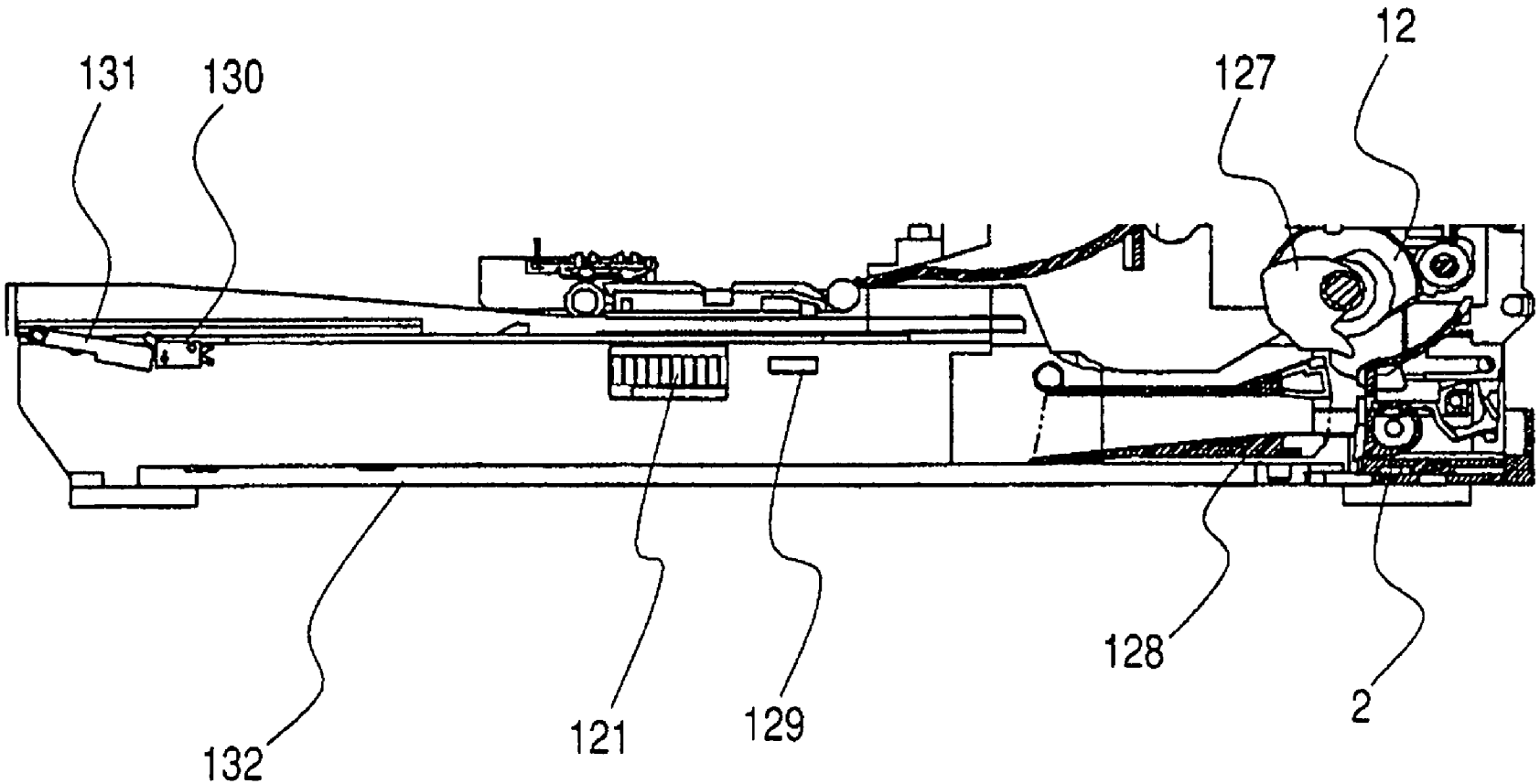
FIG. 9 is a cross sectional view showing an engine configuration before attachment of the paper feeding cassette.

From the state of FIG. 9 showing the state before attachment of the paper feeding cassette, when the paper feeding cassette 100 is inserted to the printer main body 1, a pressing plate lever 128 lowers so that a pressing plate cam 127 stops at the phase in which the spring (not shown) is in the compressed state. The home position sensor 130 of the sub-cassette 103 detects OFF since detected objects are not found at the detection lever 131.

When the paper feeding cassette 100 is inserted into the printer main body 1 along a rail 132, a contacting part 115*a* of the stopper 115 contacts a convex part 129 of the printer main body 1 and detaches from the coupling gear 114, whereby the coupling gear 114 is lock released and becomes rotatable, and the sub-cassette 103 becomes movable. When the paper feeding cassette 100 is further inserted, the coupling gear 114 and the transmission gear 121 are connected so as to be drivable with the driving source of the main body (see FIG. 8). The detection lever 131 contacts the contacting surface 116*a* of the sub-cassette detection lever 116, and detects the position of the sub-cassette 103 and turns ON. The paper feeding cassette 100 is positioned at the same time as when contacting the paper feeding unit 2, at which position the attachment of the paper feeding cassette 100 to the printer main body 1 is completed.

Figure 10:
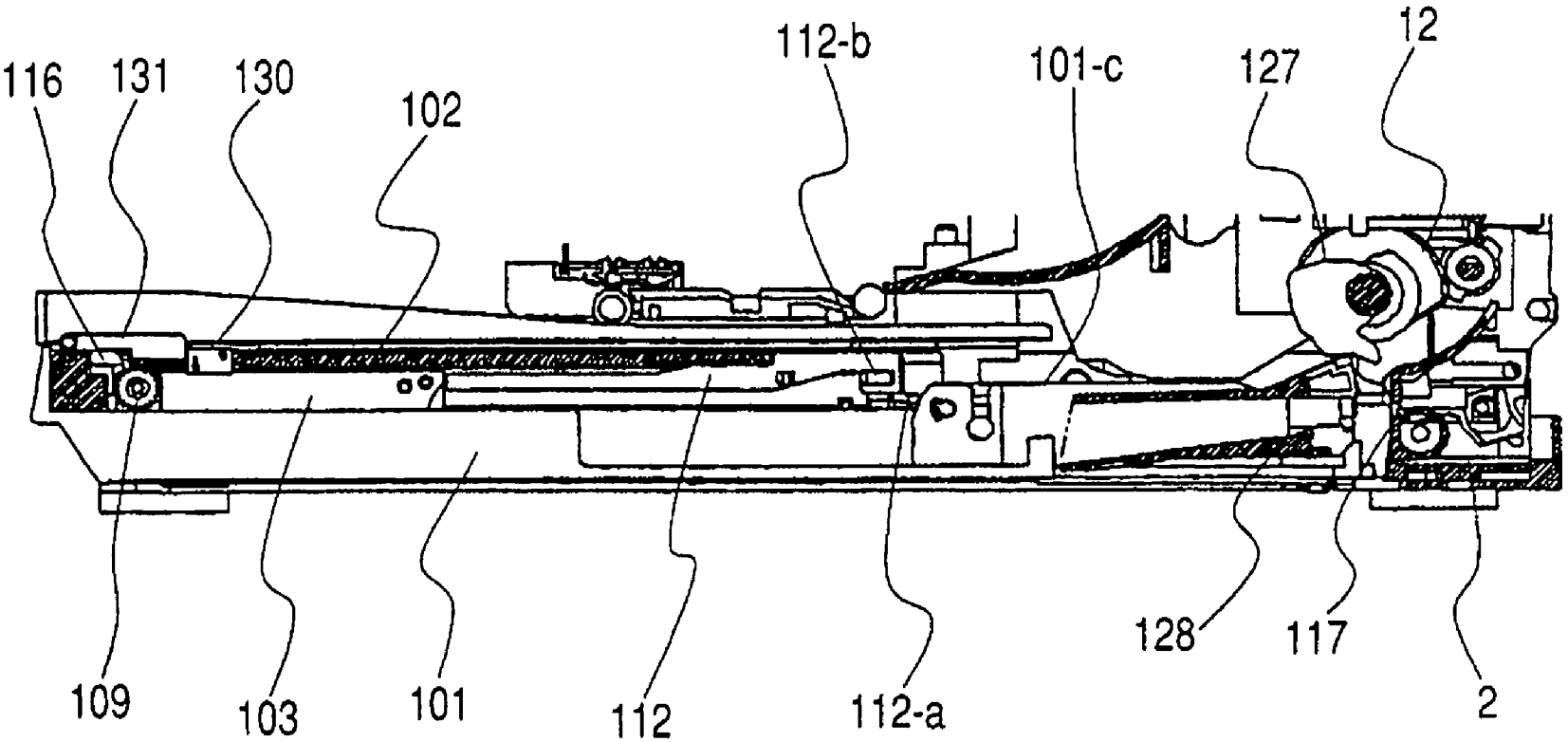
FIG. 10 is a cross sectional view showing the engine configuration in the paper feeding cassette attached state.
Figure 11:
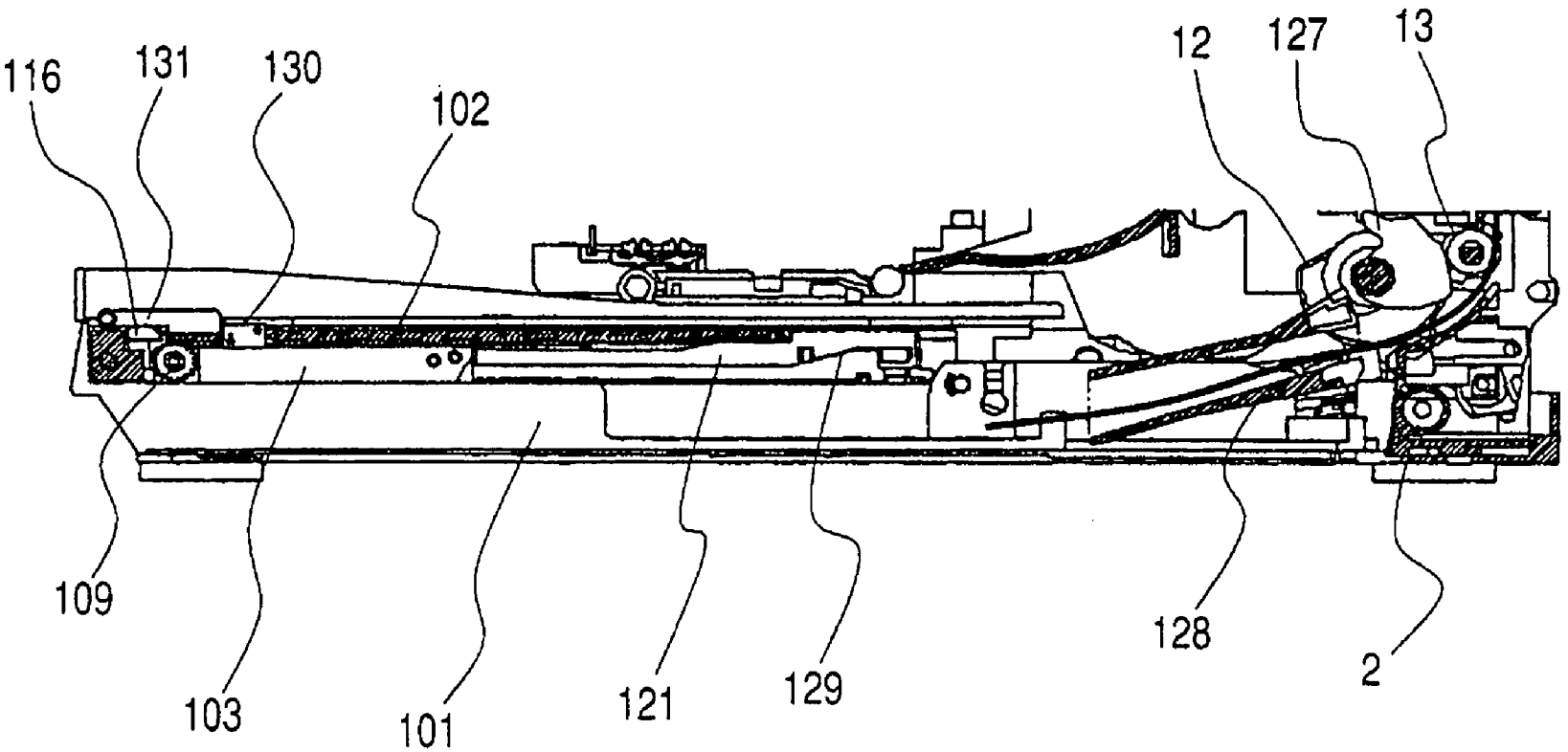
FIG. 11 is a cross sectional view showing the engine configuration in paper feeding from a main cassette.

FIG. 10 shows the paper feeding cassette attached state. The pressing plate 104 of the paper feeding cassette 100 is engaged to a groove arranged in the pressing plate lever 128. The pressing plate lever 128 and the pressing plate 104 are integrally operable in attachment. The paper feeding path is shown with an arrow in FIG. 11. When the paper feeding motor 122 rotates with the paper feeding cassette 100 attached and the paper feeding operation starts, the paper feeding roller 12 is rotated and the pressing plate lever 128 is raised according to the pressing plate cam 127. The pressing plate 104 of the paper feeding cassette 100 engaging the pressing plate lever 128 is then raised, and the paper feeding roller 12 is pressure contacted to the sheet S1 mounted on the pressing plate 104. The sheet S1 is conveyed by the rotation of the paper feeding roller 12 in this state. Here, the sheet is separated by the separating mechanism, and only one sheet is conveyed. Further, the sheet S1 is forwarded to the conveying roller 13. The paper feeding roller 12 stops after one round and the separating mechanism moves away, so that sheet conveyance is continued without being a load. Here, the state of the paper feeding cassette 100 returns to the state of FIG. 10. Thereafter, the sheet S1 reaches the LF roller 19, and conveyed to the front of the recording head 23 and completes the paper feeding operation. Subsequently, printing is performed while synchronizing the recording head 23 and the LF roller 19 according to the printing data. The sheet S1 is ejected after the printing is completed and a series of operations are completed.

(Feeding Operation of Sheet S2 from Sub-Cassette 103)

A switching operation is required to feed the sheet S2 from the sub-cassette 103. As shown in FIG. 10, the sub-cassette 103 is present at a position farthest with respect to the paper feeding direction in the paper feeding cassette 100, in the attached state of the paper feeding cassette 100. The home position sensor 130 arranged in the printer main body 1 detects ON at this stage, and detects that the sub-cassette 103 is at the proper position. In this state, the switching mechanism 125 of gear transmission switches to transmit the rotation from the paper feeding motor 122 to forward rotation and rotatably drives the paper feeding motor 122, whereby each coupling part operates as shown with an arrow A in FIG. 8, and the coupling gear 114 rotates in the direction of the arrow A. The sub-cassette 103 is moved in the paper feeding position direction (arrow A) by the gear rack 103*b* geared with the coupling gear 114. When the sub-cassette 103 starts to move from the state of FIG. 11, the sub-cassette detection lever 116 detaches from the guide shaft 109 of the sub-cassette 103 and swings, and the home position sensor 103 turns OFF. With further motor drive, the sub-cassette 103 moves forwards with the guide shaft 109 and a guide pin 103*a* along the guide groove 102*c* of the cover 102. Since the phase gear 110 arranged in phase at both ends of the guide shaft 109 moves forward while gearing with the gear rack 102*d* arranged on the cover 102, it moves smoothly without trouble. When further driven, the stopper lever 112 of the distal end of the sub-cassette 103 slightly lowers along a guide surface 101*b* of the main cassette 101 and moves forward and finally enters into a hole 117 of the PF base, and the sub-cassette 103 moves up to the paper feeding position.

Figure 12:
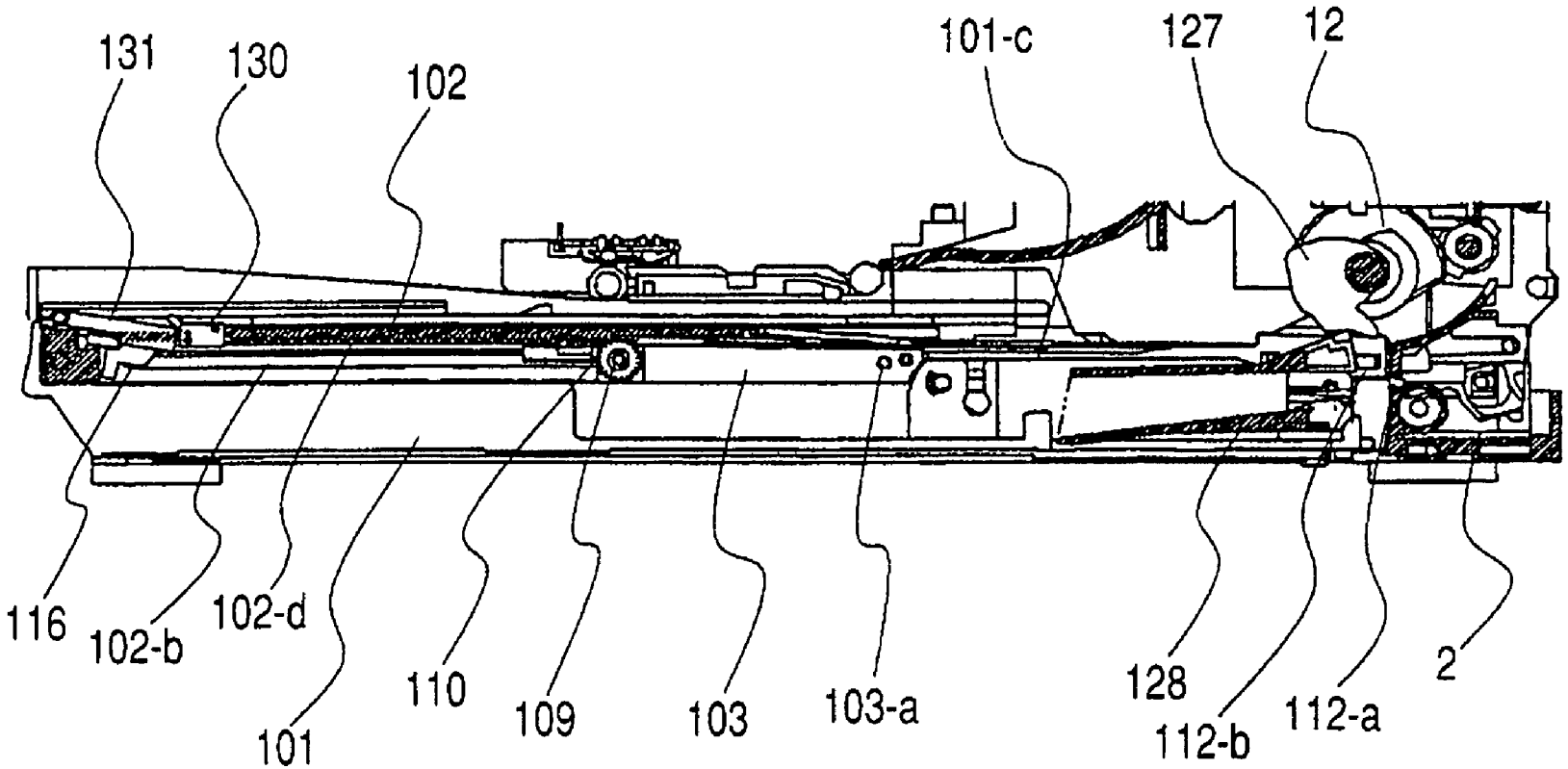
FIG. 12 is a cross sectional view showing a state in which the sub-cassette is moved to a paper feeding position.

FIG. 12 shows a state in which the sub-cassette 103 moved up to the paper feeding position. After the distal end of the sub-cassette 103 contacts, the rotation from the paper feeding motor 122 stops without excess load by the clutch gear 124 of the transmission gear train. Thereafter, the switching mechanism 125 returns to a state in which the drive of the paper feeding motor 122 and the transmission gear train are disconnected. In the waiting position, when the sub-cassette 103 held in the cover 102 moves to the paper feeding position, the guide pin 103*a* on the distal end side is released from the guide, and is thereby guided only by the guide shaft 109. Thus only the distal end side of the sub-cassette 103 is freely swung with the guide shaft 109 as the center.

Figure 13:
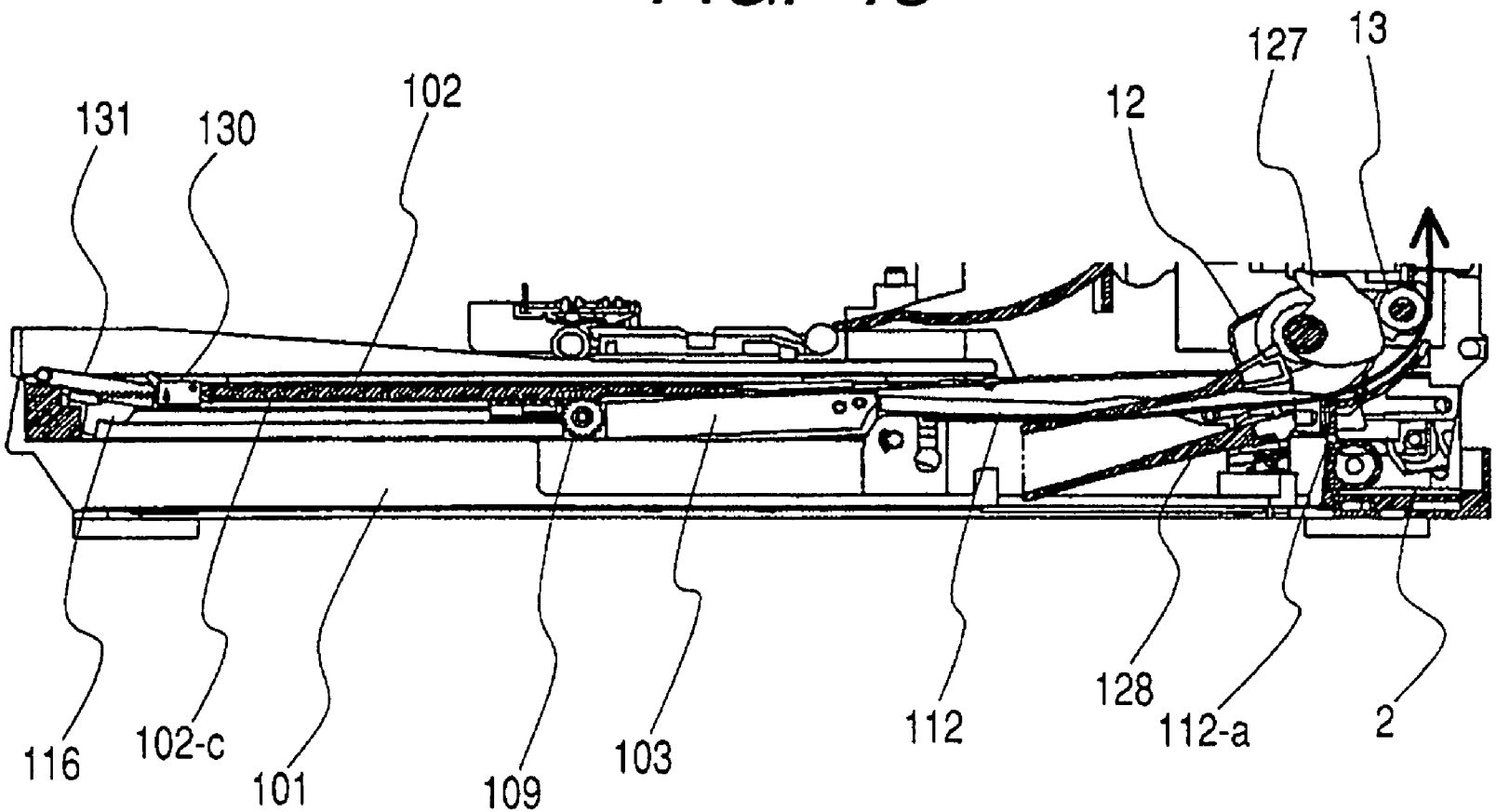
FIG. 13 is a cross sectional view showing the engine configuration during paper feeding from the sub-cassette.

The sheet S2 is thereby fed from the sub-cassette 103. FIG. 13 shows a state of feeding the sheet S2 from the sub-cassette 103. When the paper feeding operation of the pressing plate 104 is performed with the sub-cassette 103 moved up to the paper feeding position, the pressing plate 104 of the main cassette 101 moves upward as shown in the figure, the sub-cassette 103 swings with the guide shaft 109 as the center and the distal end side thereof greatly rises, and pushed against the paper feeding roller 12. Since the stop lever 112 of the sub-cassette 103 is at a position of the original height without being pushed upward since a distal end 112*a* is inserted into the hole 117 of the PF base, the wall of the feeding side of the sheet S2 is eliminated. Thus, the sheet S2 loaded in the sub-cassette 103 is fed and printed similar to the sheet S1 of the main cassette 101.

When printing is completed, an operation for moving the sub-cassette 103 backwards is performed. When the switching mechanism 125 switches the rotation of the paper feeding motor 122 to reverse rotation and rotates the paper feeding motor 122, each coupling part operates in the direction shown with an arrow B in FIG. 8. The coupling gear 114 rotates in the direction of the arrow B, and moves the sub-cassette 103 in the waiting position direction (arrow B). When the sub-cassette 103 moves backwards, the distal end of the sub-cassette detection lever rides on the guide shaft 109 and swings, and the home position sensor 130 turns ON through the detection lever 131 and stops at the waiting position shown in FIG. 10. Subsequently, the switching mechanism 125 disconnects the drive transmission from the paper feeding motor 122 to the transmission gear train and returns to the initial state.

Therefore, the sub-cassette 103 feeds the sheet S2 while moving between the waiting position and the paper feeding position. When the paper feeding cassette 100 is removed from the printer main body 1, the gear train of drive is detached, and at the same time, the coupling gear 114 of the paper feeding cassette 100 is engaged by the stopper 115 and rotation locked, so that the sub-cassette 103 does not accidentally move. In other words, the position of the sub-cassette 103 is not shifted even if the cover 102 is lifted by the user, or the removed paper feeding cassette 100 is left in an arbitrary orientation. Thus, the operation of returning the position of the sub-cassette 103 to the waiting position (home position) every time the paper feeding cassette 100 is attached can be omitted.

The movement of the sub-cassette 103 is inhibited by locking the rotation of the coupling gear 114 in the present embodiment, but may be a configuration in which the sub-cassette 103 is directly lock fixed or lock released without the coupling gear 114. Further, the driving source is not limited to the use of the paper feeding motor 122, and other motors such as CR, LF and the like may be used. Further, the same effects are obtained when performed by hand.

Second Embodiment

Figure 14:
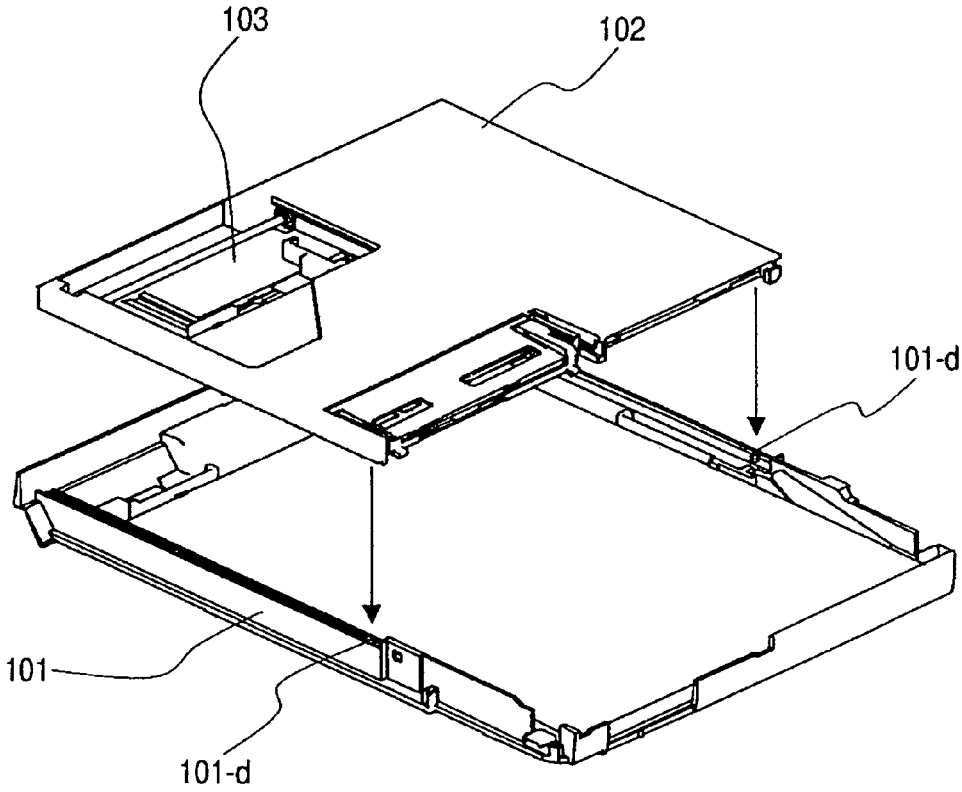
FIG. 14 is an exploded perspective view showing a paper feeding cassette according to a second embodiment.

FIG. 14 shows a second embodiment or an application of the first embodiment. In the first embodiment, a configuration of swinging the cover 102 about the supporting shaft pin 102*a* and removing the cover in a substantially vertically raised orientation with respect to the main cassette 101 is shown. In the second embodiment, on the other hand, a configuration in which the cover 102 is lifted vertically and removed in a state blocking the main cassette 101 is provided. Thus, the main cassette 101 and the sub-cassette 103 are arranged one over the other and the cover 102 is positioned to the main cassette 101 with the positioning pin 101*d*, so that the cover itself does not move when moving the sub-cassette 103. Therefore, in the case of the second embodiment, the cover 102 is easily removed with respect to the main cassette 101 when the paper feeding cassette 100 is removed from the printer main body 1, thereby enhancing the working convenience when refilling the sheets S1 to the main cassette 101.

The first and the second embodiments have the advantages described below.

(1) The trouble of changing the cassette when feeding the sheet of different size as in the prior art is omitted, and the sheet can be easily and conveniently refilled by simply removing the paper feeding cassette 100 without changing.

(2) After the paper feeding cassette 100 is taken out from the printer main body 1, the sheets can be easily refilled to the main cassette 101 and the sub-cassette 103 since the main cassette 101 can be opened and closed with the cover 102 and can also be detached.

(3) Since a power transmission mechanism for receiving power from the driving source of the printer man body 1 and moving the sub-cassette 103 is arranged in the cover 102, a mechanism for converting the forward/reverse rotational power to a reciprocating movement and moving the sub-cassette 103 forward or backward in the sheet feeding direction is easily configured and power is reliably transmitted.

(4) A lock mechanism for preventing the sub-cassette 103 from accidentally moving when taking out the paper feeding cassette 100 is arranged at the cover 102. Thus, the sub-cassette 103 does not automatically move and the initial position of the sub-cassette 103 is reliably held even if moved in the direction of opening the cover 102 in sheet refilling or changing to the main cassette 101.

(5) When a plurality of paper feeding devices are installed on the printer main body to respond to various types of sheets as in the prior art, the printer main body becomes large, and the manufacturing cost increases. In particular, the image forming apparatus of the present embodiment is suitable for low-cost type for mass consumption, in which case as well, the conventional inconvenience of changing the sheet by hand of the user is improved.

Third Embodiment

FIGS. 15 to 18 show a third embodiment. The same reference numerals are denoted for the same or common members as those in each of the first and second embodiment, and thus explanation on such redundant portions is not repeated.

Figure 15:
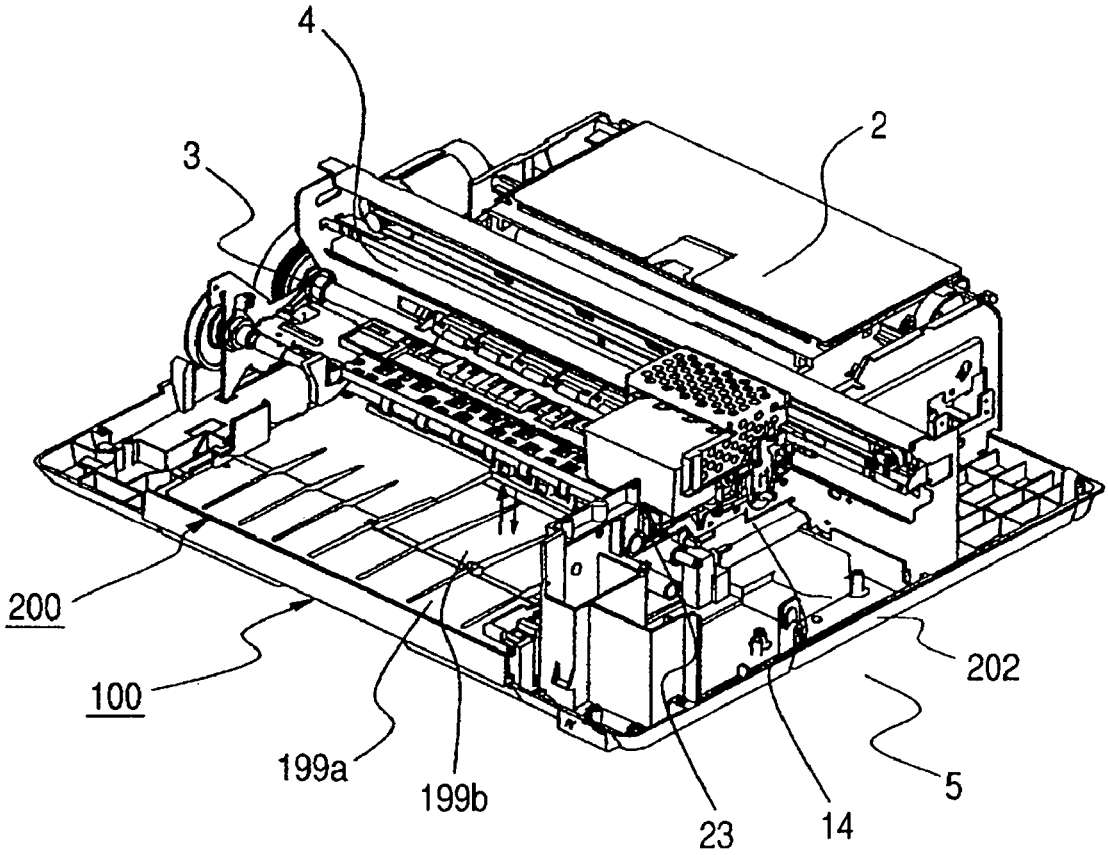
FIG. 15 is a perspective view showing a main engine configuration according to a third embodiment.

As shown in FIG. 15, an ejected paper tray 200 for stacking the sheets S ejected with printing completed in the printer main body 1 is arranged right above the paper feeding cassette 100. It includes an ejected paper surface plate 199*a* acting as a partitioning plate to the paper feeding cassette 100 below and configuring the ejected paper tray 200. The ejected paper surface plate 199*a* is arranged on a frame base 202 of the printer main body 1 through integral molding and the like, and the ejected sheets S are stacked.

Figure 16:
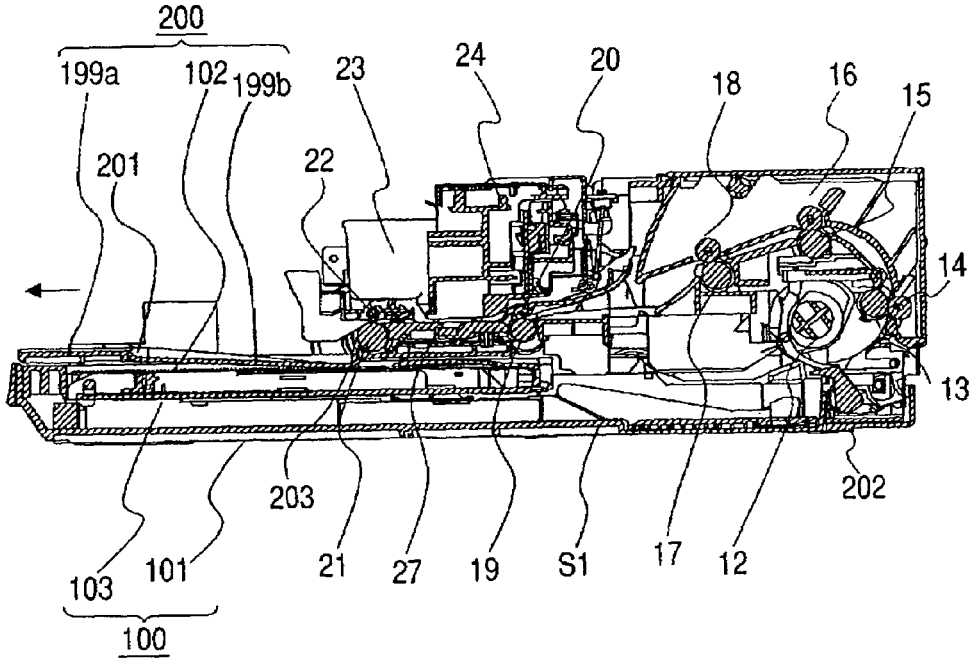
FIG. 16 is a side cross sectional view showing the engine configuration of the third embodiment.

FIG. 16 shows a paper path (sheet conveying path) in printing. The sheet S is picked up and conveyed from the paper feeding cassette 100 with the paper feeding roller 12, wherein each member or each device until printed through image forming is as explained in FIG. 3 in the first embodiment. The sheet S in which printing is completed is ejected in the direction of the arrow in the figure, and mounted and stacked on the ejected paper surface plate 199*a* of the ejected paper tray 200.

A part of the ejected paper surface plate 199*a* is formed as an ejected paper surface movable plate 199*b* corresponding to the stack of the sheet S2 conveyed from the sub-cassette 103, printed and then ejected. The ejected paper surface movable plate 199*b* can swing in the up and down direction as shown with an arrow in FIG. 15 from a swinging hinge part 201 arranged at the boundary to the paper feeding surface plate by its own weight, and a contacting part 203 at the distal end of the moving plate rides on the upper surface of the sub-cassette 103.

Figure 17A:
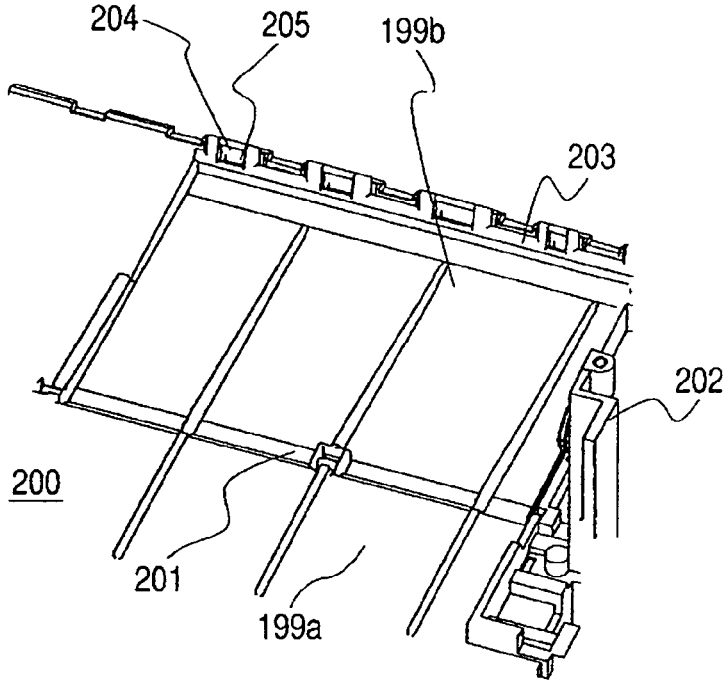
FIGS. 17A and 17B are perspective views showing an ejected paper surface movable plate configuring one part of an ejected paper tray at a fixed position in plain and a position lower than the fixed position, respectively.
Figure 17B:
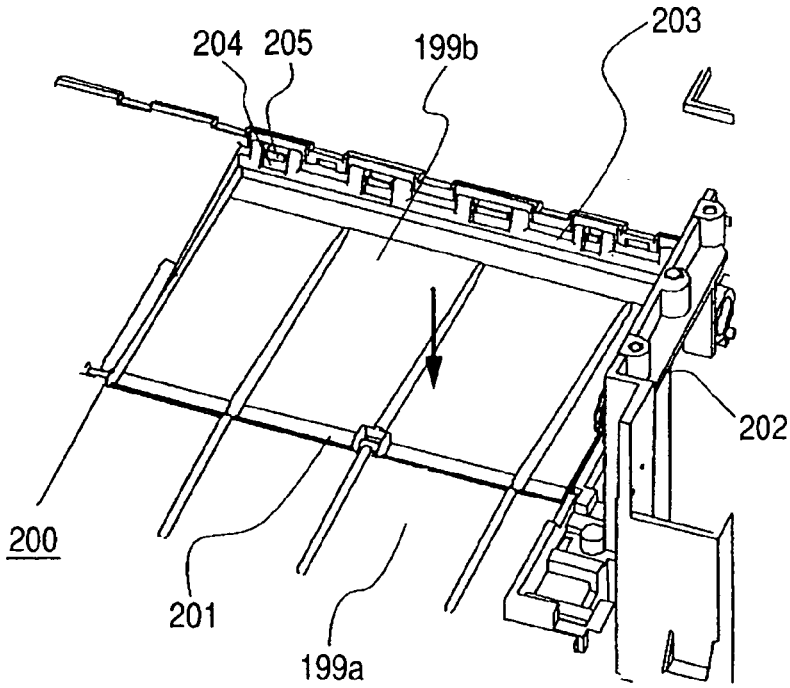

FIGS. 17A and 17B show the fixed position in which the paper feeding surface movable plate 199*b* is substantially in plain with respect to the ejected paper surface plate 199*a*, which is integral to the frame base 202, and the lowered position slightly lowered diagonally from the plain, respectively. That is, in FIG. 17B, when the sub-cassette 103 moves to the far side of the printer main body, the distal end contacting part 203 of the ejected paper surface movable plate 199*b* that was riding on the sub-cassette 103 until then drops downward by its own weight. Five concave parts 204, for example, are arranged on the ejected paper surface movable plate 199*b* side, and the dropping movement stops at a position the upper edge of the concave part hooks to an engaging nail 205 arranged at the frame base 202 side.

In other words, in the ejected paper tray 200, the movable plate 199*b* that was at the fixed position in plain with the ejected paper surface plate 199*a* moves downward diagonally (due to movement of the sub-cassette 103 to the far side), and lowers by a few mm in terms of dimension from the plain. Thus, a space depressed into a concave shape in the up and down direction is formed at one part of the ejected paper surface by having one part of the ejected paper tray 200 as the ejected paper surface movable plate 199*b* and lowering the same. Such depressed space is ensured as a sufficient mounting space even if the sheet S2 (sub-cassette accommodation) that easily curls such as post card is printed and ejected. As a result, the sheet S2 such as post card that is previously ejected is prevented from being pushed out or being contacted by the succeeding ejected sheet S2.

(Feeding Operation of Sheet S1 from Main Cassette 101)

Similar to the first embodiment, the sub-cassette 103 is at a near side position shown in FIG. 16 when feeding the sheet S1 from the main cassette 101. When the distal end contacting part 203 of the ejected paper surface movable plate 199*b* arranged in the ejected paper tray 200 is on the sub-cassette 103, the ejected paper surface movable plate 199*b* is at the fixed position at a height substantially in plain with the ejected paper surface plate 199*a*. At such in plain height, the ejected paper surface movable plate 199*b* forms an ejected paper surface for stacking the printed sheet S1 as one part of the ejected paper surface plate 199*a*.

(Feeding Operation of Sheet S2 from Sub-Cassette 103)

Similar to the first embodiment, the sub-cassette 103 advances until contacting the paper feeding position at the far side of the printer main body 1 when feeding the sheet S2 from the sub-cassette 103. In a state where the sub-cassette 103 advances, the ejected paper surface movable plate 199*b* on the ejected paper tray 200 side displaces to a position dropped to the lower side as in FIG. 17B.

Figure 18:
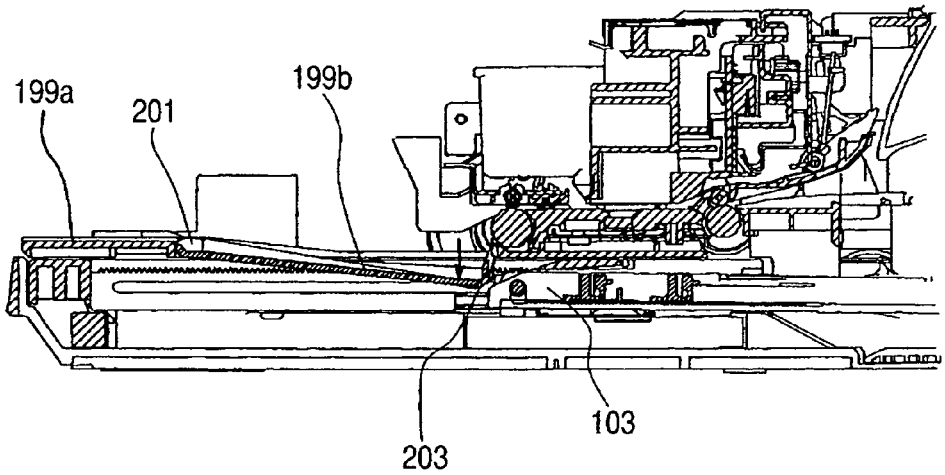
FIG. 18 is a cross sectional view in the vicinity of the ejected paper tray with the sub-cassette in the advanced state.

As shown in FIG. 18, the ejected paper surface movable plate 199*b* lowered diagonally is in a positional relationship that partially enters inside the main cassette 101. Further, the sub-cassette 103 is formed with a cam surface (not shown) on which the distal end contacting part 203 of the ejected paper surface movable plate 199*b* is placed and guided, and the ejected paper surface movable plate 199*b* swings up and down with the movement of the sub-cassette 103. Therefore, the ejected paper surface movable plate 199*b* is lifted and returns to the upper side position and recovers when the sub-cassette 103 again moves backward. Thus, a series of operations from feeding to ejecting from the sub-cassette 103 are similar to that of the first embodiment with the sub-cassette 103 in the contacting state.

As described above, the third embodiment resolves the problems of production of curls that differ depending on whether the sheet S2 is thick or thin, or on the size and the weight of the sheet; and of rubbing between the previous sheet and the succeeding sheet. In other words, as the ejected paper surface movable plate 199*b* arranged at one part of the ejected paper tray 200 displaces on the lower side and forms a concave depression, a step difference that enlarges the stacking space in the mounting direction is secured. Thus, the rubbing between the first sheet S2 and the second sheet even for the sheet type that greatly produces curls is avoided.

The present invention is not limited to each of the above embodiment, and other embodiments, applications, and variants as well as the combination thereof are also possible within a scope of the principle of the present invention.

For instance, in the third embodiment, a configuration in which the ejected paper surface movable plate 199*b* of movable type arranged at one part of the ejected paper surface plate 199*a* configuring the ejected paper tray 200 lowers diagonally by its own weight from the swinging hinge part 201 has been explained. However, it is not limited to the configuration of lowering by its own weight, and a configuration in which the ejected paper surface movable plate 199*b* is biased in the upward direction or the downward direction with a spring member, and moved against the spring member with the movement of the sub-cassette 103 is also possible. Further, a configuration in which the movement in the ejected paper tray 200 becomes unnecessary by directly contacting the sub-cassette 103, and arranging a cam mechanism and the like for moving the ejected paper tray 200 in the middle of the drive transmission part from the driving source to the sub-cassette 103, and synchronizing and moving the same may also be adopted.

According to the sheet feeding device of the present invention, sheets of different sizes can be simultaneously accommodated in one sheet accommodating section by using a cover member, and the sheet is also fed from the sub-accommodating part in a state attached to the image forming apparatus main body, and thus the trouble of the user changing for every sheet of different size is saved and satisfactory usability is provided. In addition, at least one part of the ejected paper surface of the ejected paper tray for stacking the paper that has been fed from the sub-accommodating part and printed and ejected is lowered in conjunction with the movement of the sub-accommodating part to enlarge the ejected paper space, and the space for stacking is ensured even if curls are produced at the ejected sheet. Thus, enlargement of the entire device is suppressed and the manufacturing cost is reduced by miniaturizing the ejected paper tray.

According to the image forming apparatus of the present invention, since sheets of different sizes are accommodated in one removable sheet accommodating section of cassette type and fed through switching, a feeding device for feeding the sheet of different size becomes unnecessary, whereby the entire image forming apparatus is miniaturized by such amount and is particularly suitable for adaptation to low-cost type targeted for the consuming public.

This application claims priority from Japanese Patent Application No. 2005-145093 filed May 18, 2005, and Japanese Patent Application No. 2005-261520 filed Sep. 9, 2005 which are hereby incorporated by reference herein.

What is claimed is:

1. A sheet feeding device comprising a sheet accommodating section detachably attachable with an image forming apparatus main body, comprising:

a first accommodating part for accommodating sheets;

a cover member for opening and closing said first accommodating part;

a second accommodating part arranged to said cover member, for accommodating sheets smaller in size than the sheets accommodated in said first accommodating part; and a transmission member arranged to said cover member, for transmitting the power from a power driving source of the image forming apparatus main body to said second accommodating part, whereby said second accommodating part is movable with relation to said first accommodating part, wherein a lock member is arranged in the sheet accommodating section, the lock member inhibiting the operation of the transmission member and locking the movement of the second accommodating part.

2. The sheet feeding device according to claim 1, further comprising a switching mechanism for sending the sheet from either the first accommodating part or the second accommodating part with the sheet accommodating section attached to the image forming apparatus main body.

3. The sheet feeding device according to claim 2, wherein power from the driving source is transmitted through switching by a switching mechanism to move the second accommodating part forward or backward in the sheet feeding direction.

4. The sheet feeding device according to claim 1, wherein the cover member is axially supported to the first accommodating part at one end side to be freely opened and closed, or is detachably attachable from the first accommodating part.

5. A sheet feeding device comprising a sheet accommodating section detachably attachable with an image forming apparatus main body, comprising:

a first accommodating part for accommodating sheets;

a cover member for opening and closing said first accommodating part;

a second accommodating part arranged to said cover member, for accommodating sheets smaller in size than the sheets accommodated in said first accommodating part;

a transmission member arranged to said cover member, for transmitting the power from a power driving source of the image forming apparatus main body to said second accommodating part, whereby said second accommodating part is movable with relation to said first accommodating part; and an ejected paper tray for mounting and stacking sheets ejected from the image forming apparatus main body, at least one part of an ejected paper surface of the ejected paper tray lowering with the movement of the second accommodating part and depressing into a concave shape to enlarge a stack space in a mounting direction.

6. The sheet feeding device according to claim 5, wherein the ejected paper tray includes a swing hinge part for allowing swing in a direction where at least one part of the ejected paper surface lowers and a contacting part that contacts the second accommodating part when the second accommodating part is positioned on an upstream side of the sheet feeding direction, and wherein at least one part of the ejected paper surface swings in the lowering direction when the contacting part is released from the contacting state with the movement of the second accommodating part in a downstream direction.

7. The sheet feeding device according to claim 6, wherein at least one part of the ejected paper surface drops and swings with the swing hinge part as a swing supporting point when released from the contacting state at the contacting part by its own weight or a biasing force of a spring member.

8. An image forming apparatus detachably attached with a sheet accommodating section, comprising:

a first accommodating part for accommodating sheets;

a cover member for opening and closing said first accommodating part;

a second accommodating part arranged to said cover member, for accommodating sheets smaller in size than the sheets accommodated in said first accommodating part; and a transmission member arranged to said cover member, for transmitting the power from a power driving source to said second accommodating part, whereby said second accommodating part is movable with relation to said first accommodating part, wherein a lock member is arranged in the sheet accommodating section, the lock member inhibiting the operation of the transmission member and locking the movement of the second accommodating part.

9. The image forming apparatus according to claim 8, further comprising a switching mechanism for sending the sheet from either the first accommodating part or the second accommodating part with the sheet accommodating section attached to the image forming apparatus main body.

10. The image forming apparatus according to claim 9, wherein power from the driving source is transmitted through switching by the switching mechanism to move the second accommodating part forward or backward in the sheet feeding direction.

11. The image forming apparatus according to claim 8, wherein the cover member is axially supported to the first accommodating part at one end side to be freely opened and closed, or is detachably attachable from the first accommodating part.

12. An image forming apparatus detachably attached with a sheet accommodating section, comprising:

a first accommodating part for accommodating sheets;

a cover member for opening and closing said first accommodating part;

a second accommodating part arranged to said cover member, for accommodating sheets smaller in size than the sheets accommodated in said first accommodating part; and a transmission member arranged to said cover member, for transmitting the power from a power driving source to said second accommodating part, whereby said second accommodating part is movable with relation to said first accommodating part; and an ejected paper tray for mounting and stacking sheets ejected from the image forming apparatus main body, at least one part of an ejected paper surface of the ejected paper tray lowering with the movement of the second accommodating part and depressing into a concave shape to enlarge a stack space in a mounting direction.

13. The image forming apparatus according to claim 12, wherein the ejected paper tray includes a swing hinge part for allowing swing in a direction where at least one part of the ejected paper surface lowers and a contacting part that contacts the second accommodating part when the second accommodating part is positioned on a upstream side of the sheet feeding direction, and wherein at least one part of the ejected paper surface swings in the lowering direction when the contacting part is released from the contacting state with the movement of the second accommodating part in a downstream direction.

14. The image forming apparatus according to claim 13, wherein at least one part of the ejected paper surface drops and swings with the swing hinge part as a swing supporting point when released from the contacting state at the contacting part by its own weight or a biasing force of a spring member.

* * * * *